US005929616A

United States Patent [19]

Perraud et al.

[11] Patent Number: 5,929,616

[45] Date of Patent: Jul. 27, 1999

[54] DEVICE FOR VOLTAGE REGULATION WITH A LOW INTERNAL DISSIPATION OF ENERGY

[75] Inventors: Jean-Claude Perraud, Saint Aubin sur Mer; Philippe Maugars, Rânes, both of France

[73] Assignee: U.S. Philips Corporation, New York, N.Y.

[21] Appl. No.: 08/882,444

[22] Filed: Jun. 25, 1997

[30] Foreign Application Priority Data

Jun. 26, 1996 [FR] France ..... 96 07940

[51] Int. Cl.[6] ..... G05F 3/28

[52] U.S. Cl. ..... 323/274; 323/314

[58] Field of Search ..... 323/273, 274, 323/276, 277, 313, 314

[56] References Cited

U.S. PATENT DOCUMENTS

| | | | |
|---|---|---|---|
| 3,996,498 | 12/1976 | Schade, Jr. | 323/313 |
| 4,338,646 | 7/1982 | Davis et al. | 361/18 |
| 5,010,292 | 4/1991 | Lyle, Jr. | 323/274 |
| 5,550,462 | 8/1996 | Nakajima | 323/277 |
| 5,570,060 | 10/1996 | Edwards | 323/313 |
| 5,629,611 | 5/1997 | McIntyre | 323/313 |
| 5,686,858 | 11/1997 | Malherbe | 323/315 |
| 5,747,974 | 5/1998 | Jeon | 323/274 |

OTHER PUBLICATIONS

"Verminderen van warmtedissipatie" by W. Birkhoff; Radio Bulletin; Sep. 1977; p. 339.

*Primary Examiner*—Peter S. Wong
*Assistant Examiner*—Derek J. Jardieu
*Attorney, Agent, or Firm*—Dicran Halajian

[57] ABSTRACT

A voltage regulator is disclosed which is connected to an external resistor. The voltage regulator provides a regulated voltage and includes first and second transistors. The first transistor has a power terminal connected to a power supply and the second transistor has an output terminal to output the regulated voltage. The second transistor is connected to the first transistor through a common terminal. The external resistive circuit is connected between the common terminal and the output terminal. An output current of the voltage regulator on the output terminal is equal to a sum of a first current passing through the resistive circuit and a second current passing through the second transistor. A control circuit is also provided which is connected to the input of the second transistor to turn on the second transistor for providing the second current when the first current exceeds a predetermined value. The voltage regulator also includes a comparison circuit which feeds back the regulated voltage to an input of the second transistor to regulate the regulated voltage.

15 Claims, 1 Drawing Sheet

DEVICE FOR VOLTAGE REGULATION WITH A LOW INTERNAL DISSIPATION OF ENERGY

BACKGROUND OF THE INVENTION

1. Field of the Invention

The invention relates to a voltage-regulating device having first and second power supply terminals and an output terminal at which the device supplies, under a variable output current, a regulated output voltage, the device including a buffer circuit which comprises:

first and second transistors arranged in series between the first power supply terminal and the output terminal, a comparison module having one output and two inputs, one input receiving at least a portion of the output voltage and the other receiving a reference voltage, a module for controlling the distribution of the energy dissipated by the device, driven by the output of the comparison module.

2. Description of the Related Art

A buffer circuit as described above is known from the article "Verminderen van warmtedissipatie" by W. Birkhoff, published in the Radio Bulletin of September 1977. The buffer circuit described in this article comprises a module for controlling the distribution of the energy, allowing the dissipation to be distributed substantially evenly among the two transistors. However, such a buffer circuit presents a problem when one wishes to realize it in the form of an integrated circuit. Since an integrated circuit includes components of reduced dimensions, it can dissipate only a low power, with the risk of destruction of these components. At a constant output voltage, the power which the buffer circuit must dissipate is proportional to the output current. The output current of such a buffer circuit is thus necessarily limited.

It is an object of the invention to remedy this drawback by providing a voltage-regulating device in which the power to be dissipated by the buffer circuit is reduced without the output current value being limited.

To this end, a voltage-regulating device according to the invention is characterized in that the device is provided with an electrical circuit allowing a part of the power dissipated by the output current to be discharged outside of the buffer circuit.

An embodiment of the invention provides a voltage-regulating device as defined in the opening paragraph, which is characterized in that the device comprises a first resistor, a first terminal of which is connected to the output terminal of the device and a second terminal is connected to the junction point between the first and second transistors, and in that the control module is provided with means for shunting at least a part of the output current in said first resistor.

A considerable part of the power is thus dissipated in the resistor and thus at the exterior of the buffer circuit.

An advantageous embodiment of the invention provides a voltage-regulating device as described above, which is characterized in that the control module comprises a third transistor arranged in a current-mirror configuration with the first transistor, the collector of the third transistor being connected to a terminal of a second resistor, the other terminal of which is connected to the base of the second transistor and to the output of the comparison module.

In such a device, the voltage drop at the terminals of the second resistor controls the conduction of the second transistor. In a first period, this transistor is not turned on and the quasi-total amount of power is dissipated in the first resistor outside of the buffer circuit. It is not until the output current becomes sufficiently large to saturate the first transistor that the second transistor is turned on, thus allowing the buffer circuit to internally dissipate a surplus of power which the first resistor cannot handle.

A variant of the invention provides a voltage-regulating device as described above, which is characterized in that the device comprises a fourth transistor arranged in a current-mirror configuration with the first transistor, the fourth transistor constituting a current source for biasing the comparison module.

This variant allows the buffer circuit to adapt its energy consumption to the conditions in which it operates. The currents which it consumes are substantially proportional to the current which flows through the first transistor, which current is equal to the output current. When this current is low, the current consumed by the overall buffer circuit is low.

A preferred embodiment of the invention provides a voltage-regulating device as described above, which is characterized in that the first and second transistors have a surface which is several times larger than that of the third and fourth transistors.

In such a device, the currents consumed by the third and fourth transistors are reduced to a fraction of the output current, which allows a considerable reduction of the power consumed by the buffer circuit.

A particular embodiment provides a voltage-regulating device as described above, which is characterized in that the first, second, third and fourth transistors are PNP transistors.

Another variant of the invention provides a voltage-regulating device as described above, which is characterized in that the comparison module comprises:

a voltage-divider bridge arranged between the output terminal and one of the power supply terminals, a comparator having one output and a first and a second input, the first input receiving the reference voltage, and the second input being connected to a junction point of the divider bridge, a fifth transistor whose base is connected to the output of the comparator, the emitter being connected to the second power supply terminal and the collector being connected to the base of the second transistor.

These and other aspects of the invention are apparent from and will be elucidated with reference to the embodiments described hereinafter.

DESCRIPTION OF THE PREFERRED EMBODIMENTS

Figure 1:
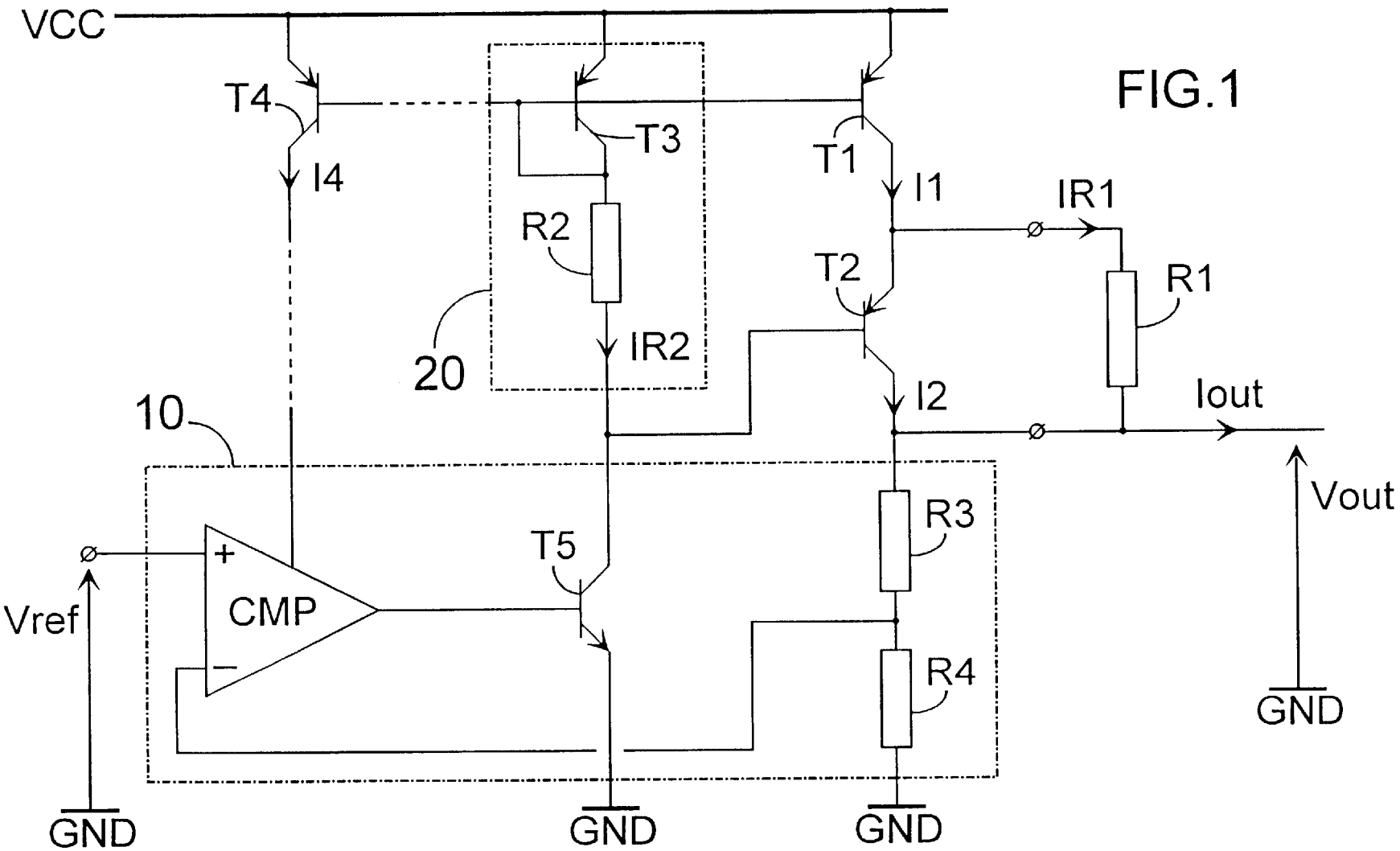
FIG. 1 shows a circuit diagram illustrating an embodiment of a voltage-regulating device in accordance with the invention.

In FIG. 1, a voltage-regulating device in accordance with a preferred embodiment of the invention has first and second power supply terminals (VCC, GND) and an output terminal at which the device supplies, under a variable output current Iout, a regulated output voltage Vout, this device including a buffer circuit which comprises:

first and second transistors (T1, T2) arranged in series between the power supply terminal VCC and the output terminal, a comparison module 10 having one output and two inputs, one input receiving at least a portion of the output voltage Vout and the other receiving a reference voltage Vref, a module 20 for controlling the distribution of the energy dissipated by the device, driven by the output of the comparison module 10. This device also comprises a first resistor (R1), a first terminal of which is connected to the output terminal of the device and a second terminal is connected to the junction point between the first and second transistors (T1, T2). The control module comprises a third transistor (T3) arranged in a current-mirror configuration with the first transistor (T1), the collector of the third transistor (T3) being connected to a terminal of a second resistor (R2), the other terminal of which is connected to the base of the second transistor (T2) and to the output of the comparison module 10. The first and second transistors (T1, T2) have a surface which is N times larger than that of the third and fourth transistors (T3, T4). The first, second, third and fourth transistors (T1, T2, T3, T4) are PNP transistors. The comparison module 10 comprises:

a voltage-divider bridge (R3, R4) arranged between the output terminal and the power supply terminal GND, a comparator CMP having one output and first and second inputs, the first input receiving the reference voltage Vref, and the second input being connected to the junction point between the resistors R3 and R4, a fifth transistor T5 whose base is connected to the output of the comparator CMP, the emitter being connected to the power supply terminal GND and the collector being connected to the base of the second transistor T2.

In such a device, the output voltage Vout is regulated by the feedback realized by means of the divider bridge (R3, R4) and the comparator CMP in the comparison module 10. The comparator CMP is of the operational amplifier type. A simple calculation yields Vout=Vref.(R3+R4)/R4. The comparator CMP is constructed on the basis of differential pairs which are biased in this case by a current resulting from the reproduction, by means of a current-mirror type configuration, of the current supplied by the fourth transistor T4. As T4 is N times smaller than T1, this current is substantially equal to Iout/N. The comparator CMP thus consumes little energy when the output current Iout is low.

The control module 20 operates as follows. When Iout is low, only the transistor T1 is turned on. The transistor T3, which is N times smaller than T1, then conveys a current which is substantially equal to Iout/N. The voltage drop in the resistor R2, equal to R2.Iout/N is small. As the base-emitter voltage of the transistor T2 is too large to allow it to be turned on, T2 remains turned off. The quasi-total amount of the output current Iout consequently flows in the resistor R1 which thus dissipates a large part of the power outside of the buffer circuit.

When Iout increases, the voltage drop in the resistor R2 increases. The base-emitter voltage of the transistor T2 decreases until T2 is allowed to turn on at the instant when T1 starts saturating. The resistor R1 then conveys a portion IR1 of the output current Iout, the transistor T2 conveying the other portion of Iout and thus taking over a part of the energy dissipation.

We claim:

1. A voltage regulator for providing a regulated voltage and comprising:

a first transistor having a power terminal connected to a power supply;

a second transistor having an output terminal and being connected to said first transistor through a common terminal;

an external resistive circuit connected between said common terminal and said output terminal; an output current of said voltage regulator being equal to a sum of a first current passing through said external resistive circuit and a second current passing through said second transistor;

a control circuit connected to an input of said second transistor to turn on said second transistor for providing said second current when said first current exceeds a predetermined value; and a comparison circuit which feeds back said regulated voltage to said input of said second transistor to regulate said regulated voltages;

wherein said control circuit comprises a third transistor configured as a current mirror of said first transistor to bias said second transistor, and wherein a fourth transistor is configured as another current mirror of said first transistor to bias said comparison circuit, said third and fourth transistors having a surface area which is smaller than a surface area of said first and second transistors.

2. The voltage regulator of claim 1 further comprising a fifth transistor connected between said comparison circuit and said input of said second transistor.

3. A voltage for providing a regulated voltage and comprising:

a first transistor having a power terminal connected to a power supply;

a second transistor having an output terminal and being connected to said first transistor through a common terminal;

an external resistive circuit connected between said common terminal and said output terminal; an output current of said voltage regulator being equal to a sum of a first current passing through said external resistive circuit and a second current passing through said second transistor; and a control circuit connected to an input of said second transistor to turn on said second transistor for providing said second current when said first current exceeds a predetermined value;

wherein said control circuit comprises a third transistor configured as a current mirror of said first transistor to bias said second transistor, and wherein a fourth transistor is configured as another current mirror of said first transistor to bias a comparison circuit connected between said output terminal and an input of said second transistor, said third and fourth transistors having a surface area which is smaller than a surface area of said first and second transistors.

4. The voltage regulator of claim 3, wherein said first current dissipates sufficient energy external to said voltage regulator to allow miniaturization of said voltage regulator.

5. The voltage regulator of claim 3, wherein a power dissipated through said external resistive circuit reduces a power rating of said voltage regulator without reducing said output current.

6. The voltage regulator of claim 3, wherein a required value of said second current necessary to achieve a predetermined value of said output current is reduced by a value of said first current.

7. The voltage regulator of claim 3, wherein said external resistive circuit is a resistor.

8. The voltage regulator of claim 3, wherein said third transistor provides a biasing current to said input of said second transistor through a biasing resistor.

9. The voltage regulator of claim 3, wherein said comparison circuit feeds back said regulated voltage to said input of said second transistor to regulate said regulated voltage.

10. The voltage regulator of claim 3, wherein said comparison circuit comprises:

a voltage divider which divides said regulated voltage to provide a divided regulated voltage;

a comparator which receives said divided regulated voltage for comparison with a reference voltage; and a fifth transistor which is connected between an output of said comparator and said input of said second transistor.

11. A voltage regulator comprising a control circuit, a buffer circuit and a resistive circuit connected to said buffer circuit, an output current of said voltage regulator being equal to a sum of a first current passing through said resistive circuit and a second current provided directly from said buffer circuit, said control circuit turning on said second transistor to shunt said resistive circuit when said first current exceeds a predetermined value, wherein said control circuit comprises a third transistor configured as a current mirror of said first transistor to bias said second transistor, and wherein a fourth transistor is configured as another current mirror of said first transistor to bias a comparison circuit connected between said output terminal and an input of said second transistor, said third and fourth transistors having a surface area which is smaller than a surface area of said first and second transistors.

12. The voltage regulator of claim 11, wherein said resistive circuit dissipates power to reduce a power dissipated by said buffer circuit.

13. The voltage regulator of claim 11, wherein said resistive circuit dissipates power consumed by said voltage regulator external to said buffer circuit.

14. The voltage regulator of claim 11, wherein said buffer circuit dissipates a surplus power of said voltage regulator when said output current exceeds a predetermined value.

15. The voltage regulator of claim 11 further comprising a fifth transistor connected between said comparison circuit and said input of said second transistor.

* * * * *